US006014960A

United States Patent [19]

Oleksiewicz

[11] Patent Number: 6,014,960

[45] Date of Patent: Jan. 18, 2000

[54] EXHAUST GAS RECIRCULATION CONTROL APPARATUS

[75] Inventor: Radek A. Oleksiewicz, Riverwoods, Ill.

[73] Assignee: Navistar International Transportation Corp, Chicago, Ill.

[21] Appl. No.: 09/188,722

[22] Filed: Nov. 9, 1998

[51] Int. Cl.[7] ..... F02M 25/07

[52] U.S. Cl. ..... 123/568.2

[58] Field of Search ..... 123/568.11, 568.12, 123/568.2, 568.21; 60/278

[56] References Cited

U.S. PATENT DOCUMENTS

| | | | |
|---|---|---|---|
| 3,530,843 | 9/1970 | Fessenden | 123/568.11 |
| 4,142,491 | 3/1979 | Hibino et al. | 123/568.2 |
| 4,142,492 | 3/1979 | Kobayashi et al. | 123/568.11 |
| 4,249,374 | 2/1981 | Sugasawa et al. | 60/278 |
| 4,409,949 | 10/1983 | Tanaka et al. | 123/568.2 |
| 4,459,965 | 7/1984 | Brachert | 123/568.2 |
| 4,506,633 | 3/1985 | Britsch | 123/568.11 |
| 5,562,086 | 10/1996 | Asada et al. | 123/568.21 |
| 5,762,051 | 6/1998 | Okamoto | 123/568.2 |

*Primary Examiner*—Willis R. Wolfe

*Attorney, Agent, or Firm*—Dennis K. Sullivan; Jeffrey P. Calfa

[57] ABSTRACT

An internal combustion engine includes an exhaust gas recirculation control apparatus includes first and second normally closed valves having different flow areas which open to provide communication between a corresponding bank of an exhaust manifold and an intake manifold. Each valve is engaged to an actuator which reciprocates the valve between a fully open and fully closed position. Both actuators are independently operable under control of an ECU programmed to monitor operational parameters of a specific engine via sensors functionally engaged thereto to maintain the engine at a level of optimum performance, the ECU producing in response to sensor input, a no-flow level and an appropriate one of three possible active levels of recirculation. A no-flow level maintaining both valves closed allows no recirculation, an active first level maintaining both valves open allows maximum recirculation, an active second level maintaining a larger valve open allows less than maximum recirculation and an active third level maintaining a smaller valve open allows a level of recirculation greater than none.

11 Claims, 1 Drawing Sheet

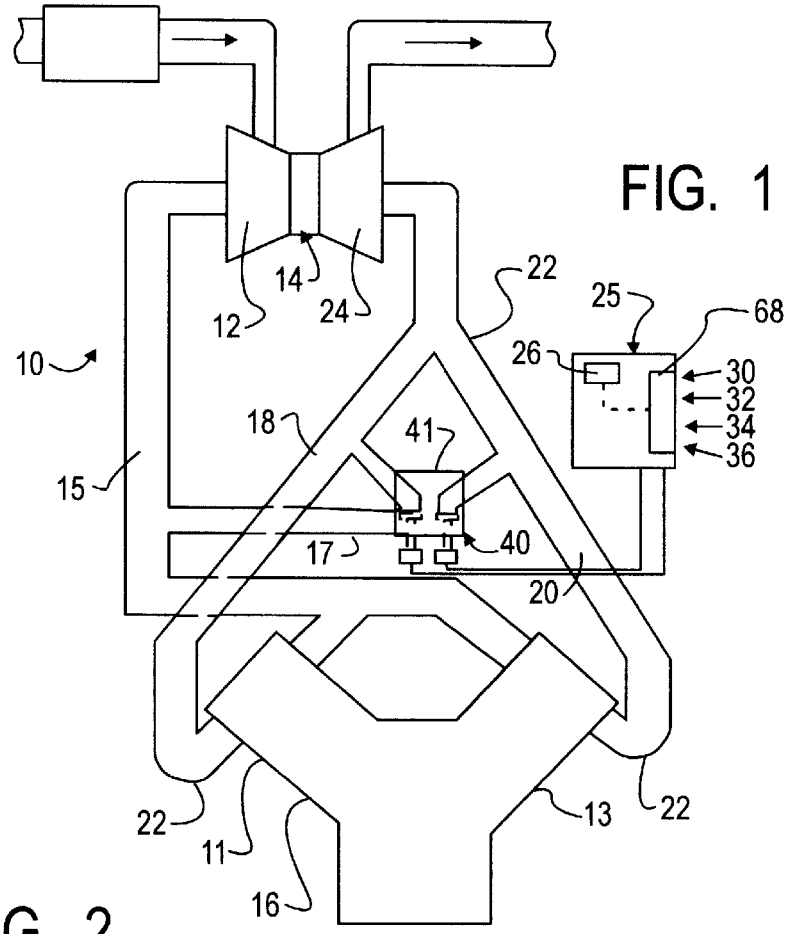
FIG. 1
FIG. 2
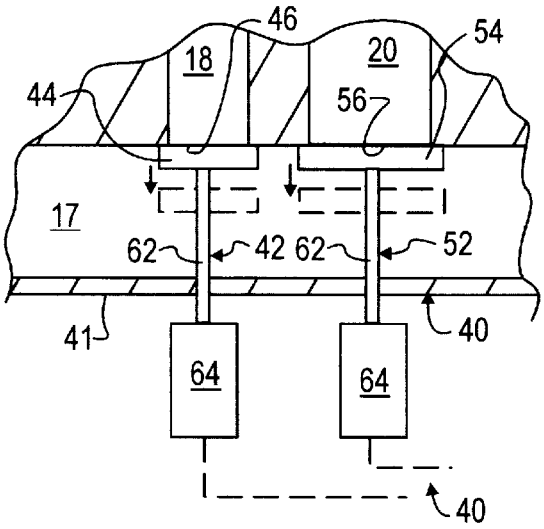
FIG. 3
| MODE | VALVE 42 | VALVE 52 | EGR FLOW |
|---|---|---|---|
| 1 | CLOSED | CLOSED | NONE |
| 2 | OPEN | CLOSED | FLOW 42 |
| 3 | CLOSED | OPEN | FLOW 52 |
| 4 | OPEN | OPEN | FLOW 42 & FLOW 52 |

EXHAUST GAS RECIRCULATION CONTROL APPARATUS

BACKGROUND OF THE INVENTION

The present invention relates to exhaust gas recirculation (EGR) control apparatus for internal combustion engines. More particularly, the exhaust gas recirculation control apparatus of the invention includes two valves to provide a plurality of predefined, engine specific, active levels or stages of recirculation from low flow to maximum flow, as well as an "off" condition with no flow while maintaining optimal engine performance and without requiring dedicated feedback of the EGR valve position for determining the appropriate level of operation.

THE PRIOR ART

Heretofore various embodiments of exhaust gas recirculation control apparatus have been proposed. In most cases, the EGR valve has only one active position as well as a closed position. This does not provide appropriate EGR flow under all the various engine speed and load conditions which the EGR may encounter in a well tuned engine. Other have used a linear, modulated EGR valve wherein the valve has a variety of positions depending on the engine requirements. However, such modulated EGR valves depend on feedback of the EGR valve position to function.

SUMMARY OF THE INVENTION

A primary object of the present invention to provide an open loop exhaust gas recirculation control apparatus capable of providing a plurality of predefined, engine specific active levels or stages of exhaust gas recirculation while maintaining optimal engine performance without a dedicated feedback circuit for inputting the EGR valve position, mass airflow, or manifold pressure to assure the appropriate operation thereof.

In the present invention, an EGR valve apparatus is provided which has a multitude of predefined active stages, as well as a closed stage. This is accomplished by the provision of at least two separately actuable on/off valves within the EGR apparatus which, under control of the engine microprocessor, may provide three active EGR valve positions providing different levels of flow and a "closed" position.

More specifically, in a V-configuration engine, the exhaust gas recirculation control apparatus of the present invention comprises a first valve operable to allow communication between an exhaust manifold of a first bank and a common intake manifold of the engine and a second valve operable to allow a second level of communication between an exhaust manifold of a second bank of the engine and the intake manifold, each valve being engaged by a suitable actuator which reciprocates the respective valve between a fully closed and a fully open position and separately actuable from the other valve under direction of an ECU of the engine in response to one or more sensed operational parameters of the engine, the EGR apparatus providing three possible active levels or stages of recirculation which do not compromise optimal performance of the engine, the levels ranging from low flow to maximum flow, and also a "closed" stage.

BRIEF DESCRIPTION OF THE DRAWINGS

FIG. 1 is a simplified diagram of an exemplary EGR system of an engine incorporating the control apparatus of the present invention.

FIG. 2 is an enlarged perspective view of a preferred embodiment of the exhaust gas recirculation control apparatus of FIG. 1.

FIG. 3 is a chart showing the levels of recirculation provided by the control apparatus of FIG. 1 provided positioning of the valves thereof.

DESCRIPTION OF THE PREFERRED EMBODIMENT

Referring now to the drawings in greater detail, there is illustrated in FIG. 1 a schematically exemplary embodiment of a turbocharged internal combustion engine 16 having an exhaust gas recirculation system generally identified by the reference numeral 10. The engine 16 is of V-type configuration having left and right banks of cylinders 11, 13.

Typically, pressurized air from a compressor 12 of a turbocharger 14 enters a common intake manifold 15 feeding into both banks of the engine 16 where air mixes with fuel which, when compressed by piston action, undergoes combustion, with chemical remnants of combustion, such as NOx, being carried away from the engine 16 via an exhaust manifold 22 of the engine 16 disposed on each bank 11, 13, the exhaust manifolds 22 feeding first and second passages 18 and 20, respectively, connected to a turbine 24 of the turbocharger 14 which drivingly engages the compressor 12 thereof.

To remove the NOx from the engine exhaust gas, such exhaust gas is preferably recirculated back through EGR valve 40 and passage 17 into the intake manifold 15, directly or indirectly, and is reburned, the instantaneous amount of exhaust gas capable of being accommodated for recirculation without compromising optimal engine 16 performance being dependent upon operational parameters of the engine 16 monitored by an ECU 25 thereof. In this respect, if there is an excessive amount of exhaust gas being recirculated into the intake manifold 15, it will cause the engine 16 to operate at a level of performance which is less than optimal, as well as potentially causing damage thereto.

Consequently, the amount of exhaust gas to be recirculated (level of recirculation) is controlled by the ECU 25 in response to sensed operational parameters of the engine 16 as compared to those required for optimal engine 16 performance. The ECU 25 analyzes readings received from various engine sensors, compares the readings to parameter values stored in a memory 26 thereof which are predetermined to produce optimal engine 16 performance and causes necessary actions in various devices controlled thereby to maintain the engine 16 at an optimal level of performance. Specific sensors which could be used in establishing appropriate control of exhaust gas recirculation could be, as an example, one or more of an intake manifold temperature sensor 30, a mass air flow sensor 32, an engine speed sensor 34 and a pedal position sensor 36

The EGR control apparatus 40 disclosed herein has been designed to be operable under control of the ECU 25, in a predefined manner, in response to readings of parameters already being monitored by the ECU 25, without requiring a dedicated sensor or feedback circuit for appropriate activation thereof.

Turning now to FIG. 2, there is illustrated therein a preferred embodiment of the exhaust gas recirculation control apparatus made in accordance with the teachings of the present invention and generally identified by the reference numeral 40. As shown, the apparatus 40 includes a valve housing 41 having a first exhaust inlet port 46 connected to the left bank exhaust passage 18 and a second exhaust inlet port 56 connected to the right bank exhaust passage 20 and an outlet passage 17 leading to the intake manifold 15. A first normally-closed poppet valve 42 is mounted in the housing 41 for linear axial movement and has a valve head 44 disposed coaxially with the port 46 to open and close the port. A second normally-closed poppet valve 52 is mounted in the housing 41 for linear axial movement and has a valve head 54 disposed coaxially with a port 56, which is larger in flow area, than the port 46, Thus, the valves 42 and 52 are disposed in parallel to provide exhaust gas to the inlet 17. In this embodiment, the sources for the two valves are different; however, for the broader aspects of this invention, the sources could be the same, i.e., a single exhaust manifold 22.

Each valve head 44 and 54 is secured to a valve stem 62 which extends to a corresponding linear actuator 64 therefor, such as a spring-biased solenoid, with each actuator 64 being operable to cause retraction of the associated valve stem 62 to open the respective valve 42 or 52, as determined to be appropriate by the ECU 25 which is operatively engaged to each actuator 64 and is programmed to provide independent activation of each actuator 64 depending on engine conditions.

Inasmuch as two independently operable valves 42 and 52 are provided, with the port 56 being larger than the port 46, the apparatus 40 is capable of producing combinations of open and closed positions of valve 42, 52, to provide a first inactive or closed mode or stage and three active mode or stages of recirculation providing different flow amounts, as defined in FIG. 3. A first mode or stage in which neither valve 42 or 52 is retracted to an open so that both ports 46 and 56 are maintained closed provides no recirculation. A second stage in which both valves 42 and 52 are retracted, opening both ports 46 and 56 provides a maximum level of recirculation. A third stage in which only valve 52 is retracted, opening the larger port 56 provides a less than maximum level of recirculation, and a fourth state in which only valve 42 is retracted, opening the smaller port 46 produces a minimal level of recirculation.

The operational parameters for optimizing engine performance are engine specific, being very dependent on variations in engine speed and loading. As is well known in the engine industry, through empirical testing, a range of values for at least one, and preferably all, of the sensed engine parameters 30, 32, 34, or 36 described above, can be established for each desired stage of recirculation and stored in the memory 26 of the ECU 25. Thereafter, upon the sensed value level of the parameters, at any given moment, being compared by a comparator 68 of the ECU 25 to the stored value ranges, and the comparator 68 generating an appropriate signal as a result of the comparison, each of the valves 42 and 52 can be independently positioned in an open or closed position to produce the corresponding stage of recirculation considered appropriate for maintained optimal performance of the engine 16. Since the valves 42 and 52 are either open or closed there is no need for feedback to the ECU of the valve position.

As discussed above, the EGR valves 42 and 52 provide parallel exhaust flow to the intake manifold through different sized ports to provide three active stages of recirculation. It will be appreciated that, if desired, up to seven active stages of recirculation could be provided through the addition of a third valve arrangement similar to and parallel with the valves 42 and 52, with the port for the third valve connecting to the same source as one of them.

As described above, the exhaust gas recirculation control apparatus of the present invention provides a number of advantages, some of which have been described above and others of which are inherent in the invention. Also, modifications can be proposed to the control apparatus 40 without departing from the teachings herein. For instance, although use of a solenoid actuator 64 is disclosed as an example, this should not be construed as limiting inasmuch as any pneumatic, hydraulic or electronic actuator capable of operating a linearly reciprocating valve could be used in place thereof. Accordingly, the scope of the invention is only to be limited as necessitated by the accompanying claims.

What is claimed is:

1. An internal combustion engine comprising:

a plurality of cylinder banks, each bank having an exhaust manifold and an associated exhaust passage fluidly separated from an exhaust passage of another bank, and an intake manifold shared with the other bank;

an exhaust gas recirculation valve apparatus including:

a housing having a first and second separate exhaust inlet passages connected exclusively respectively at one end to each of said banks, said first passage having a first port communicating with the intake manifold and said second passage having a second port communicating with the intake manifold; and first and second valve members mounted for linear movement in said housing, said first valve member being disposed to move from a closed position sealing said first port to an open position permitting exhaust flow from said first port to said intake manifold, said second valve member being disposed to move from a closed position sealing said second port to an open position permitting exhaust flow from said second port to said intake manifold, each of said valve members being functionally engaged to a linear actuator;

and an engine ECU operatively associated with said linear actuators to independently operate each of said first and second valve members to be either in said open position or said closed position to provide one of a plurality of predetermined valve position configurations providing varying amounts of EGR flow in response to at least one sensed operational parameter of the engine being monitored by the ECU falling within one of a plurality of predetermined ranges for such parameter stored in the ECU memory corresponding to said one of a plurality of predetermined valve position configurations, thereby providing a particular mode of exhaust gas recirculation.

2. The engine of claim 1 wherein said EGR is responsive to a plurality of sensed operational parameters and the provision of said one of a plurality of predetermined valve position configurations is dependent on each of sensed operational parameters falling within predetermined ranges stored in the ECU memory and the combination of the plurality of sensed parameters corresponding to said one of a plurality of predetermined valve position configurations.

3. The internal combustion engine of claim 1 wherein said second port has a larger flow area than said first port.

4. The internal combustion engine of claim 1 wherein each valve position combination produces a specific and exclusive level of exhaust gas recirculation for a given engine operating condition.

5. The internal combustion engine of claim 1 wherein no exhaust gas recirculation is provided when both valves are closed.

6. The internal combustion engine of claim 1 wherein a predefined maximum level of recirculation is provided when both valves are open.

7. The internal combustion engine of claim 1 wherein a less than maximum level of recirculation is provided when only the second valve is open.

8. The internal combustion engine of claim 1 wherein a level of recirculation greater than none is provided when only the first valve is open.

9. The internal combustion engine of claim 1 wherein the ECU is functionally engaged to at least one predefined sensor from which a reading is elicited, the ECU including means therein for comparing the reading to a plurality of predefined ranges of such readings, the ranges being stored in a memory thereof, and based upon the particular range within which the reading is determined to lie by a comparator of the ECU, causing a level of recirculation predetermined to correspond to the particular range by appropriate valve actuation.

10. An exhaust gas recirculation apparatus for an internal combustion engine comprising:

a housing having a plurality of parallel ports in establishing communication between an engine exhaust system and an engine intake system;

a plurality of valve members associated respectively with said plurality of ports, each valve member being mounted in said housing for movement between a first position closing its associated port and a second position opening said associated port; and an actuator associated with each valve member to position said valve member in either said first position or said second position in response to an associated engine controller, the available position combinations of said valve members defining a plurality of active modes of exhaust gas flow of differing quantity and an inactive flow mode.

11. The invention in accordance with claim 10 and said first and second ports having different flow areas.

* * * * *